US008373632B2

(12) United States Patent
Oh et al.

(10) Patent No.: US 8,373,632 B2
(45) **Date of Patent: *Feb. 12, 2013**

(54) APPARATUS AND METHOD FOR DRIVING A LIQUID CRYSTAL DISPLAY DEVICE

(75) Inventors: Eui Yeol Oh, Gyeonggi-do (KR); Seong Gyun Kim, Gyeonggi-do (KR); Nam Yong Kong, Gyeonggi-do (KR)

(73) Assignee: LG Display Co., Ltd., Seoul (KR)

( * ) Notice: Subject to any disclaimer, the term of this patent is extended or adjusted under 35 U.S.C. 154(b) by 1058 days.

This patent is subject to a terminal disclaimer.

(21) Appl. No.: 11/647,202

(22) Filed: Dec. 29, 2006

(65) Prior Publication Data

US 2007/0216629 A1 Sep. 20, 2007

(30) Foreign Application Priority Data

Mar. 20, 2006 (KR) ..... 10-2006-0025407

(51) Int. Cl.
*G09G 3/36* (2006.01)

(52) U.S. Cl. ..... 345/98

(58) Field of Classification Search ..... 345/94, 345/98

See application file for complete search history.

(56) References Cited

U.S. PATENT DOCUMENTS

| | | | | |
|---|---|---|---|---|
| 5,920,300 | A * | 7/1999 | Yamazaki et al. | 345/94 |
| 2003/0095090 | A1* | 5/2003 | Ham | 345/87 |
| 2003/0142118 | A1 | 7/2003 | Funamoto et al. | |
| 2005/0030302 | A1* | 2/2005 | Nishi et al. | 345/204 |
| 2005/0068343 | A1 | 3/2005 | Pan et al. | |
| 2005/0156852 | A1* | 7/2005 | Kwon | 345/98 |
| 2005/0190164 | A1* | 9/2005 | Velthoven et al. | 345/204 |
| 2005/0232356 | A1* | 10/2005 | Gomi et al. | 375/240.16 |
| 2005/0237316 | A1 | 10/2005 | Huang et al. | |
| 2006/0158416 | A1* | 7/2006 | Ku | 345/98 |
| 2007/0057895 | A1 | 3/2007 | Kong et al. | |

FOREIGN PATENT DOCUMENTS

| | | | |
|---|---|---|---|
| DE | 10 2006 029 710 | A1 | 4/2007 |
| EP | 1 494 169 | A2 | 1/2005 |
| JP | 02-153688 | | 6/1990 |
| JP | 04-288589 | | 10/1992 |
| JP | 09-258167 | | 10/1997 |

(Continued)

OTHER PUBLICATIONS

Taiwanese Office Action dated Jun. 8, 2011.

*Primary Examiner* — Amr Awad
*Assistant Examiner* — Stephen Bray
(74) *Attorney, Agent, or Firm* — Morgan, Lewis & Bockius LLP

(57) ABSTRACT

An apparatus for driving an LCD device includes an image display unit having liquid crystal cells in respective regions defined by a plurality of gate and data lines; an over-driving apparatus to detect a signal of a moving image based on a source data and to detect modulated data based on the detected signal, the modulated data changes a response speed of a liquid crystal based on the detected signal; a gate driver to supply scan signals to the gate lines; a data driver to convert the modulated data into analog video signals and to supply the analog video signals to the data lines; and a timing controller to align the modulated data and to generate data control signal and gate control signal, the timing controller outputs the aligned data and the data control signal to the data driver and outputs the gate control signal to the gate driver.

10 Claims, 10 Drawing Sheets

FOREIGN PATENT DOCUMENTS

| | | |
|---|---|---|
| JP | 2004-233949 | 8/2004 |
| JP | 2005-043864 | 2/2005 |
| TW | 200414114 | 8/2004 |
| TW | 200601236 | 1/2006 |

* cited by examiner

2pixel/frame

4pixel/frame

6pixel/frame

8pixel/frame

APPARATUS AND METHOD FOR DRIVING A LIQUID CRYSTAL DISPLAY DEVICE

This application claims the benefit of the Korean Patent Application No. P2006-25407 filed in Korea on Mar. 20, 2006, which is hereby incorporated by reference.

BACKGROUND OF THE INVENTION

1. Field of the Invention

The present invention relates to an apparatus and method for driving a liquid crystal display (LCD) device, and more particularly, to an apparatus that improves display quality of the moving image on the LCD screen by removing blurring of the moving images, and method of driving such apparatus.

2. Discussion of the Related Art

Generally, liquid crystal display (LCD) devices adjust light transmittance of liquid crystal cells in accordance with an applied video signal to display an image. An active matrix type LCD device is suitable for displaying a moving image because a switching element is provided for every liquid crystal cell. A thin film transistor (TFT) is used as the switching element of the active matrix type LCD device.

FIG. 1 illustrates a related art apparatus for driving the LCD device. As shown in FIG. 1, the related art apparatus includes an image display unit 2 where a liquid crystal cell is formed in each region defined by first to nth gate lines GL1 to GLn and first to mth data lines DL1 to DLm, a data driver 4 supplies analog video signals to the data lines DL1 to DLm, a gate driver 6 supplies scan signals to the gate lines GL1 to GLn, and a timing controller 8 aligns input data RGB provided externally to the apparatus and supplies the aligned RGB data to the data driver 4. Further, the timing controller generates data control signals DCS to control the data driver 4 and generates gate control signals GCS to control the gate driver 6.

The image display unit 2 includes a thin film transistor array substrate, a color filter array substrate, a spacer, and a liquid crystal material interposed between the two array substrates. The thin film transistor array substrate and the color filter array substrate face each other and are bonded to each other. The spacer uniformly maintains a cell gap between the two substrates. The liquid crystal material is filled in a cell gap formed by the spacer.

The thin film transistor array substrate includes a TFT formed in the region (i.e., liquid crystal cell) defined by intersecting the gate lines GL1 to GLn and the data lines DL1 to DLm. The liquid crystal cells are connected to the TFT. The TFT supplies the analog video signals provided from the data lines DL1 to DLm to the liquid crystal cells in response to the scan signals provided from the gate lines GL1 to GLn. The liquid crystal cell includes common electrodes that face each other where the liquid crystal material is interposed between the two common electrodes, and pixel electrodes that are connected to the TFT. Therefore, the liquid crystal cell functions as a liquid crystal capacitor Clc. In addition, the liquid crystal cell includes a storage capacitor Cst to maintain the analog video signals charged in the liquid crystal capacitor Clc until the next analog video signals are charged therein.

As discussed earlier, the timing controller 8 aligns the input data RGB to desired signals in order to drive the image display unit 2. The timing controller 8 supplies the aligned RGB data to the data driver 4. In addition, the timing controller 8 generates the data control signals DCS and the gate control signals GCS using a dot clock DCLK, a data enable signal DE, and horizontal and vertical synchronizing signals Hsync and Vsync, all of which are externally provided, to control driving timings of the data driver 4 and the gate driver 6.

The gate driver 6 includes a shift register that sequentially generates scan signals (i.e., gate high signals in response to the gate control signals GCS from the timing controller 8). The gate driver 6 sequentially supplies the gate high signals to the gate lines GLs (i.e., GL1 to GLn) to turn on the TFT connected to the each gate lines GLs.

As shown in FIG. 1, signal data 'Data' aligned by the timing controller 8 is supplied to the data driver 4. In addition, data control signals 'DCS' are provided to the data driver 4 from the timing controller 8. Then, the data driver 4 converts the 'Data' into the analog video signals in response to the data control signals 'DCS' and supplies the analog video signals to the data lines DLs (i.e., DL1 to DLm). In detail, the data driver 4 selects a gamma voltage having a predetermined level based on a gray level value of the 'Data' and supplies the selected gamma voltage to the data lines DL1 to DLm. Then, the data driver 4 inverses polarity of the analog video signals supplied to the data lines DLs in response to a polarity control signal POL.

The related art LCD device has a problem in that response speed is slow due to physical properties of the liquid crystal material, such as an inherent viscosity and an elasticity of the liquid crystal material. Although the response speed of the liquid crystal material may depend on the physical properties and cell gap of the liquid crystal material, it is common for the liquid crystal cells to have a rising time in a range of 20 ms to 80 ms and a falling time in a range of 20 to 30 ms, and this response speed is longer than the one frame period (i.e., 16.67 ms in National Television Standards Committee (NTSC) format).

Accordingly, as shown in FIG. 2, numbers of frame periods may be needed for a voltage being charged to the liquid crystal cell to reach a desired level. In the related art LCD device, the image data in the previous frame period affects the image data in the next frame period, blurring of the moving images appears on the image display unit 2. In addition, viewer perception may also contribute to the blurring of the moving images. As a result, blurring of the moving images causes the degradation of contrast ratio, hence deteriorating the quality of image display on the screen. To prevent the blurring of moving images, an over-driving apparatus is suggested that achieves a fast response speed by modulating data signals.

FIG. 3 is a block diagram illustrating a related art over-driving apparatus. As shown in FIG. 3, the related art over-driving apparatus 50 includes a frame memory unit 52 to store RGB data in a previous frame Fn-1, a look-up table 54 to generate modulated data, and a mixing unit 56 to mix the modulated data from the look-up table 54 with the RGB data in the current frame Fn. The look-up table 54 compares the RGB data in the current frame Fn with a data in a previous frame Fn-1 stored in the frame memory 52. The look-up table 54 lists modulated data R'G'B' to convert a voltage level of the RGB data in the current frame Fn to a higher voltage level. Accordingly, the liquid crystal material may provide a faster response speed.

As shown in FIG. 4, a voltage level higher than an actual data voltage is applied to the liquid crystal material using the look-up table 54, thus, the blurring of moving images can be reduced. However, since the related art over-driving apparatus 50 generates the modulated data by comparing the data in the current frame with the data in the previous frame, removing the blurring of moving images is limited.

SUMMARY OF THE INVENTION

Accordingly, the present invention is directed to an apparatus and method for driving the liquid crystal display (LCD) device which substantially obviates one or more problems due to limitations and disadvantages of the related art.

An object of the present invention is to provide an apparatus that removes blurring of moving images on an LCD screen to improve the display quality.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, an apparatus for driving an liquid crystal display (LCD) device includes an image display unit having liquid crystal cells formed in respective regions defined by a plurality of gate lines and a plurality of data lines; an over-driving apparatus to detect a signal of a moving image based on externally supplied source data and to detect modulated data in accordance with the detected signal, wherein the modulated data changes a response speed of a liquid crystal based on the detected signal; a gate driver to supply scan signals to the gate lines; a data driver to convert the modulated data into analog video signals and to supply the analog video signals to the data lines; and a timing controller to align the modulated data and to generate data control signal and gate control signal, wherein the timing controller outputs the aligned data and the data control signal to the data driver and outputs the gate control signal to the gate driver.

In another aspect, a method for driving an liquid crystal display (LCD) device having an image display unit to display an image includes detecting a signal of a moving image from externally supplied source data and generating modulated data based on the detected signal, wherein the modulated data changes a response speed of a liquid crystal based on the detected signal; supplying scan signals to respective gate lines; and converting the modulated data into analog video signals at a time when the conversion is synchronized with the scan signals and supplying the analog video signals to respective data lines.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiments of the invention and together with the description serve to explain the principle of the invention. In the drawings.

DETAILED DESCRIPTION OF THE PREFERRED EMBODIMENTS

Reference will be made in detail to the preferred embodiments of the present invention, examples of which are illustrated in the accompanying drawings.

Figure 1:
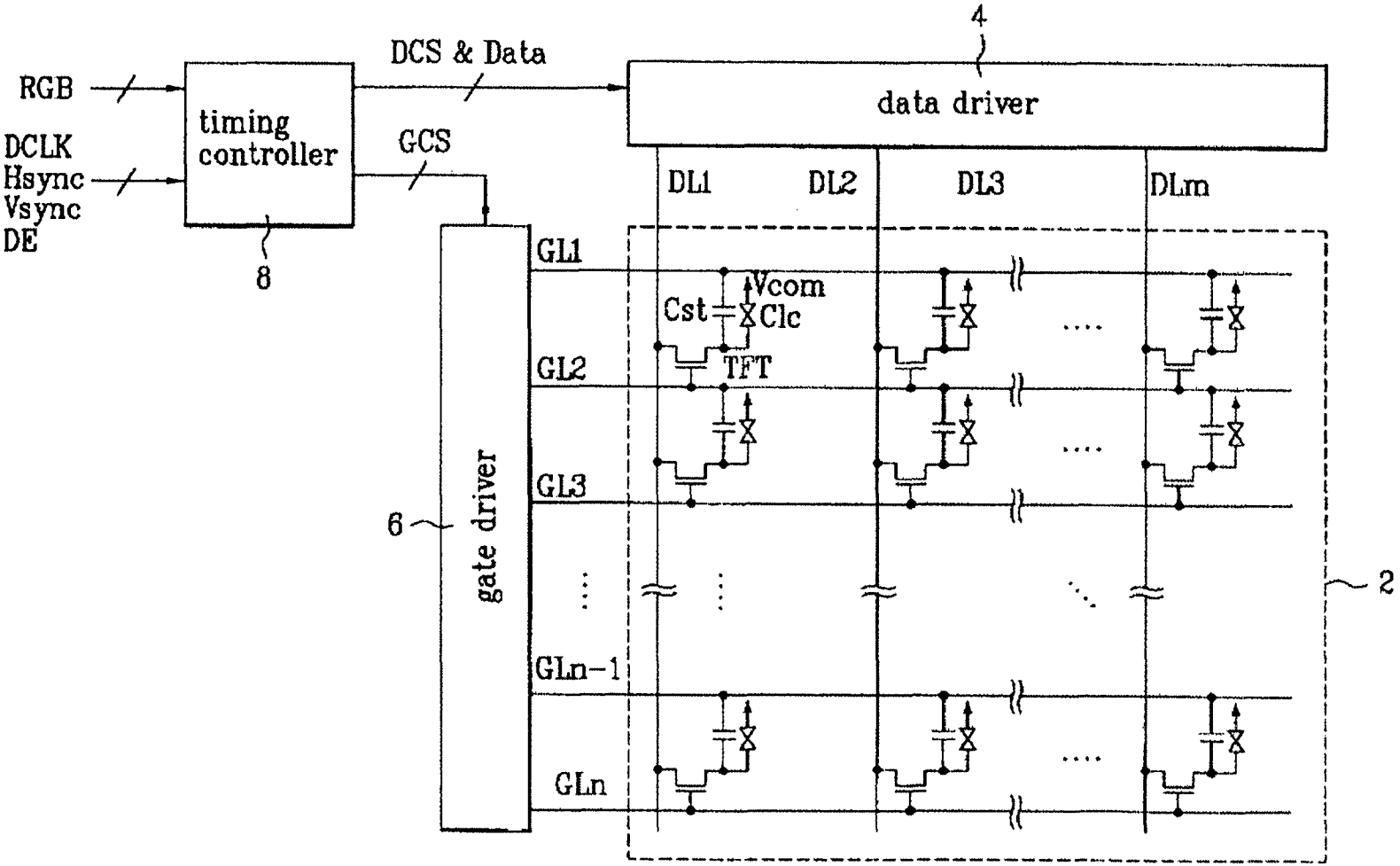
FIG. 1 Related Art
FIG. 1 illustrates a related art apparatus for driving a liquid crystal display (LCD) device.
Figure 2:
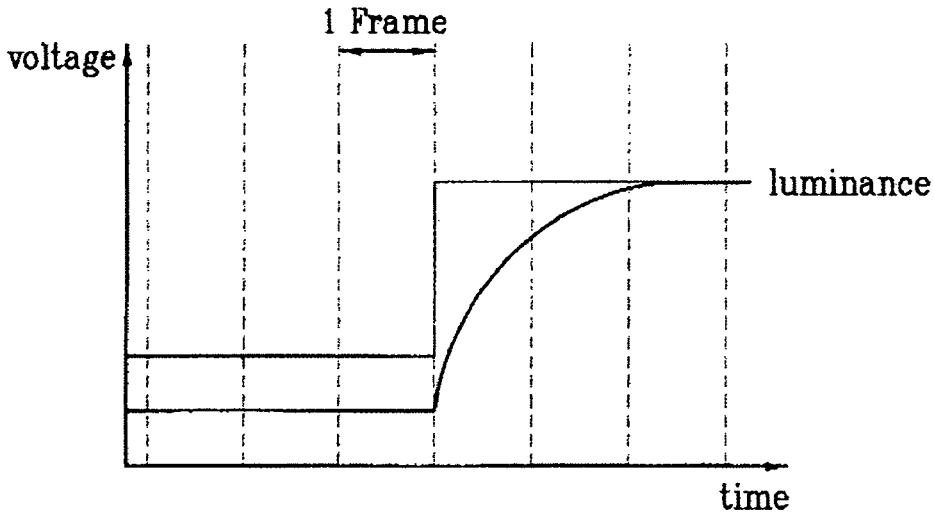
FIG. 2 Related Art
FIG. 2 illustrates a response speed and luminance of a liquid crystal cell of FIG. 1.
Figure 3:
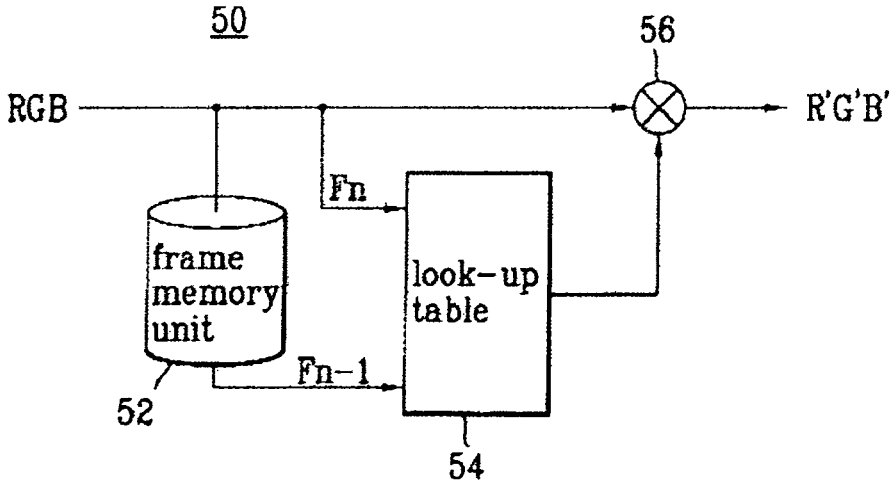
FIG. 3 Related Art
FIG. 3 is a block diagram illustrating a related art over-driving apparatus.
Figure 4:
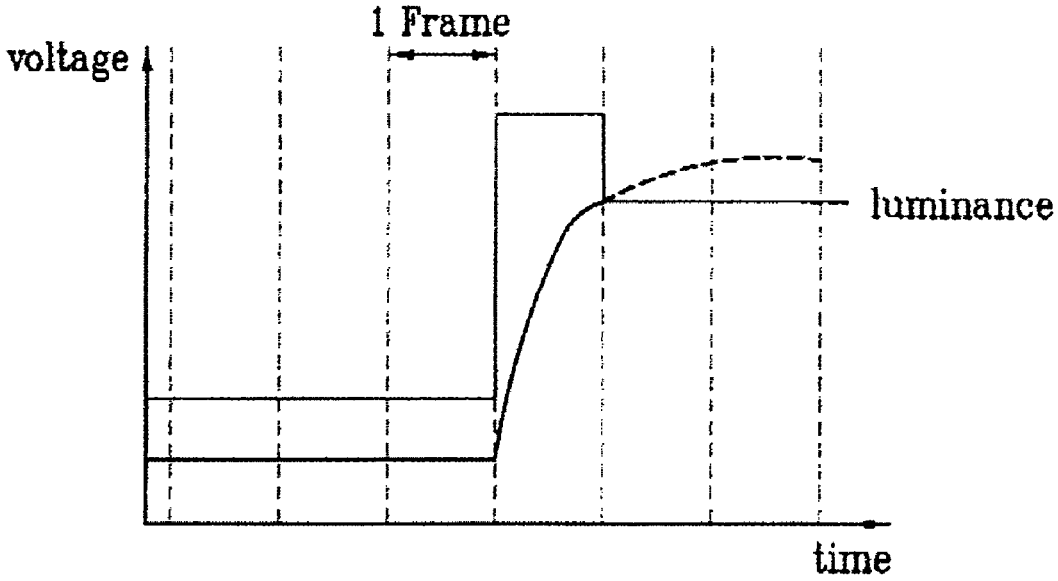
FIG. 4 Related Art
FIG. 4 illustrates a response speed and luminance of a liquid crystal cell in a related art over-driving apparatus shown in FIG. 3.
Figure 5:
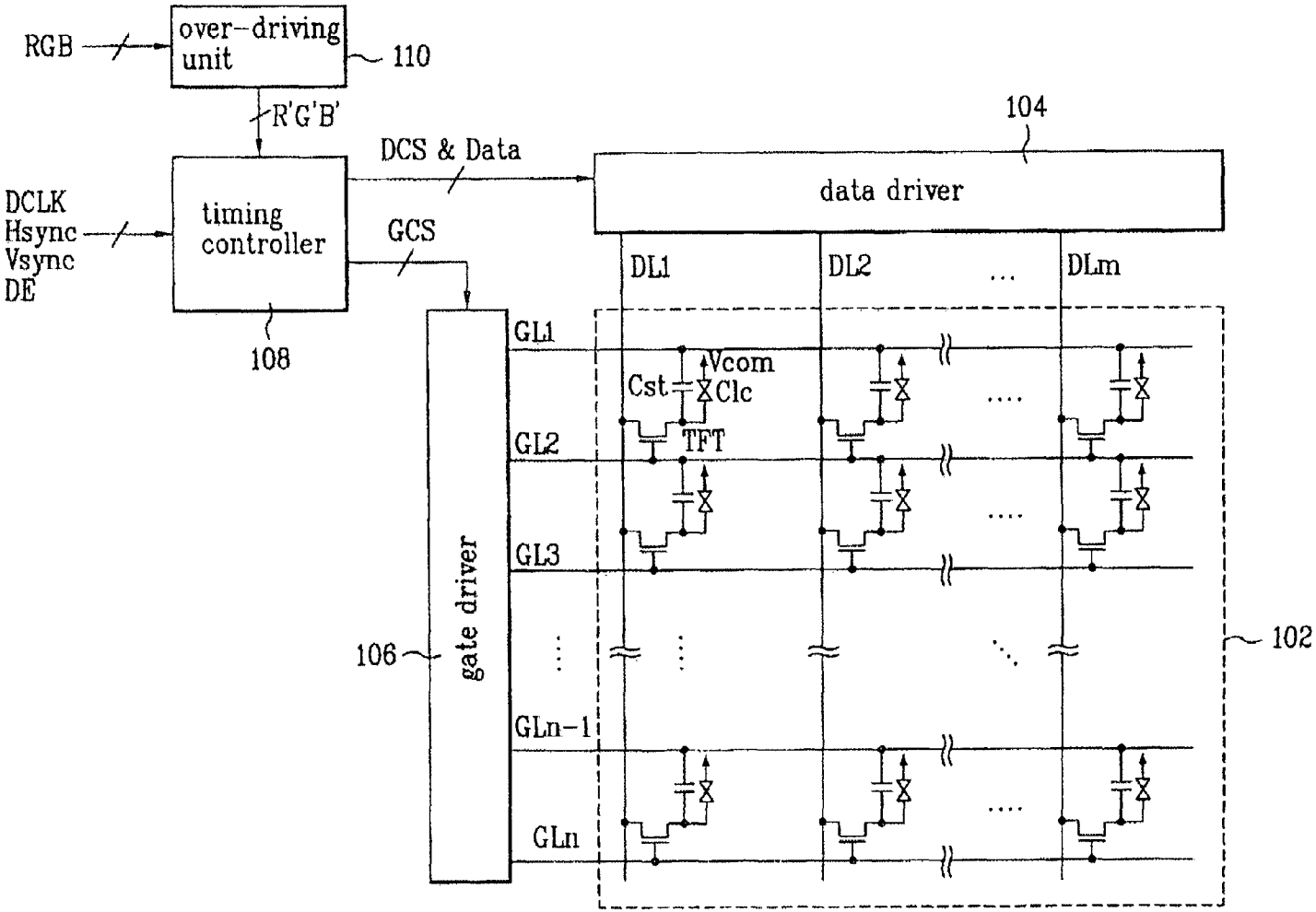
FIG. 5 illustrates an exemplary apparatus for driving an LCD device according to a first exemplary embodiment of the present invention.

FIG. 5 illustrates an exemplary apparatus for driving an LCD device according to a first exemplary embodiment the present invention. As shown in FIG. 5, the exemplary apparatus includes an image display unit 102 including liquid crystal cells formed in respective region defined by intersecting first to nth gate lines GL1 to GLn and first to mth data lines DL1 to DLm, an over-driving unit 110 to generate modulated data R'G'B' based on the externally supplied source data RGB, a gate driver 106 to supply scan signals to the gate lines GL1 to GLn, a data driver 104 to convert the modulated data R'G'B' into analog video signals and supply the converted signals to the data lines DL1 to DLm, a timing controller 108 to align the modulated data R'G'B' provided from the over-driving apparatus 110 with a data signal and supply the aligned data 'Data' to the data driver 104, to generate data control signals 'DCS' to control the data driver 104, and to generate gate control signals 'GCS' to control the gate driver 106. The modulated data help to change the response speed of a liquid crystal in accordance with a speed of a moving image.

The image display unit 102 includes a thin film transistor array substrate, a color filter array substrate, a spacer, and a liquid crystal. The thin film transistor array substrate and the color filter array substrate face each other and are bonded to each other. The spacer uniformly maintains a cell gap between the two substrates. The liquid crystal is filled in the gap created by the spacer between the two substrates.

In addition, the image display unit 102 includes a TFT formed in the respective region defined by intersecting the gate lines GLs (i.e., GL1 to GLn) and the data lines DLs (i.e., DL1 to DLm). Furthermore, the image display unit 102 includes the liquid crystal cells connected to the TFT. The TFT supplies the analog video signals received from the data lines DLs to the liquid crystal cells in response to the scan pulses received from the gate lines GLs. The liquid crystal cell includes common electrodes facing each other where the liquid crystal is disposed therebetween and pixel electrodes connected to the TFT. Thus, the liquid crystal cell functions as a liquid crystal capacitor Clc. In addition, the liquid crystal cell includes a separate storage capacitor Cst to maintain the analog video signals stored in the liquid crystal capacitor Clc until the next analog video signals are stored therein.

The over-driving apparatus 110 detects changes in a display image (i.e., motion) by comparing the source data RGB of a current frame with the data of a previous frame, and outputs modulated data R'G'B' that correspond to the speed of motion. The timing controller 108 aligns the modulated data R'G'B' with the data signals and supplies the aligned data 'Data' to the data driver 104. Furthermore, the timing controller 108 generates the data control signals 'DCS' and the gate control signals 'GCS' using a dot clock DCLK, a data enable signal DE, and horizontal and vertical synchronizing signals Hsync and Vsync, all of which are supplied externally, to control each driving timing of the data driver 104 and the gate driver 106. The data signals 'Data' are converted into the analog video signals in the data driver 104. Then, the converted analog video signals are supplied to the data lines DLs.

The gate driver 106 includes a shift register that sequentially generates scan pulses (i.e., gate high signals in response to the gate control signals GCS from the timing controller 108). The gate driver 106 sequentially supplies the gate high signals to the gate lines GLs to turn on the TFT connected to the gate lines GLs.

The data driver 104 converts the data signals 'Data' aligned from the timing controller 108 into the analog video signals. The conversion is performed in response to the data control signals 'DCS' supplied from the timing controller 108. Then, the converted analog video signals are supplies to the data lines DLs. Each converted analog video signal corresponds to one horizontal line per one horizontal period when the scan signals are supplied to respective gate lines GLs. In detail, the data driver 104 generates the analog video signals by selecting a gamma voltage having a predetermined level based on a gray level value of the data signals 'Data'. Then, the generated analog video signals are supplied to the data lines DLs. At this time, the data driver 104 inverses polarity of the analog video signals supplied to the data lines DLs in response to a polarity control signal POL.

Figure 6:
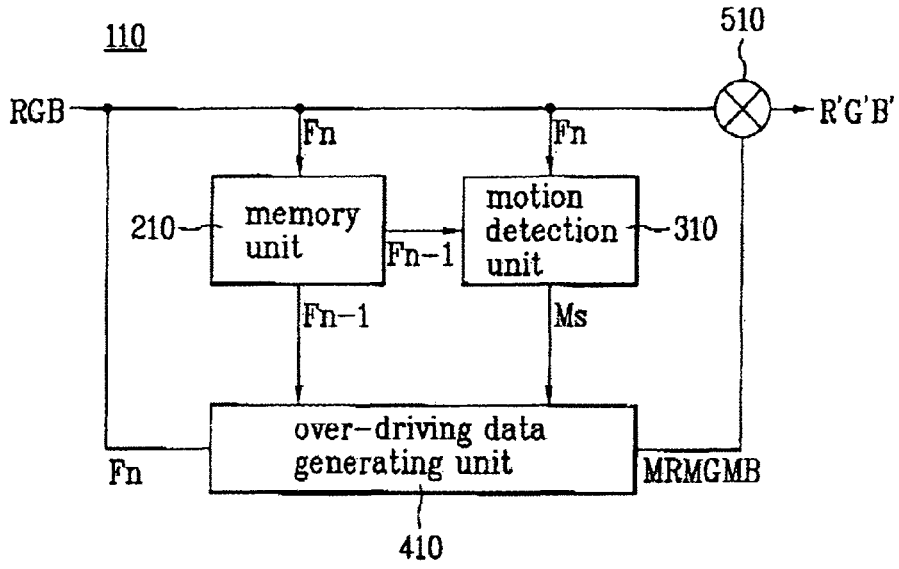
FIG. 6 is a block diagram illustrating an exemplary over-driving apparatus according to the first exemplary embodiment of the present invention.

FIG. 6 is a block diagram illustrating an exemplary over-driving apparatus according to the first embodiment of the present invention. As shown in FIG. 6, the over-driving apparatus 110 includes a memory unit 210 to store the source data RGB supplied in a frame unit format, a motion detector unit 310 to detect a motion size signal Ms that corresponds to speed of the moving image, an over-driving data generator unit 410 to generate a plurality of over-driving data using a plurality of look-up tables based on the motion size signal Ms, and a mixing unit 510 to mix the source data RGB of the current frame Fn with the over-driving data MRMGMB and output the modulated data R'G'B'.

The memory unit 210 stores the source data RGB of the current frame Fn, and outputs the data of the previous frame Fn-1 to the motion detector unit 310 and the over-driving data generator unit 410. The motion detector unit 310 detects motion vectors X and Y corresponding to X-axis displacement and Y-axis displacement with respect to the source data of the previous frame Fn-1 and the source data of the current frame Fn. Then the motion detector unit 310 detects the motion size signal Ms as expressed in the following equation 1.

$$Ms=SQRT(X^2+Y^2) \quad \text{[Equation 1]}$$

The motion detector unit 310 supplies the detected motion size signal Ms to the over-driving data generator unit 410. In this case, the motion size signal Ms represents motion speed that corresponds to the number of pixels changed per frame of the moving image.

Figure 7:
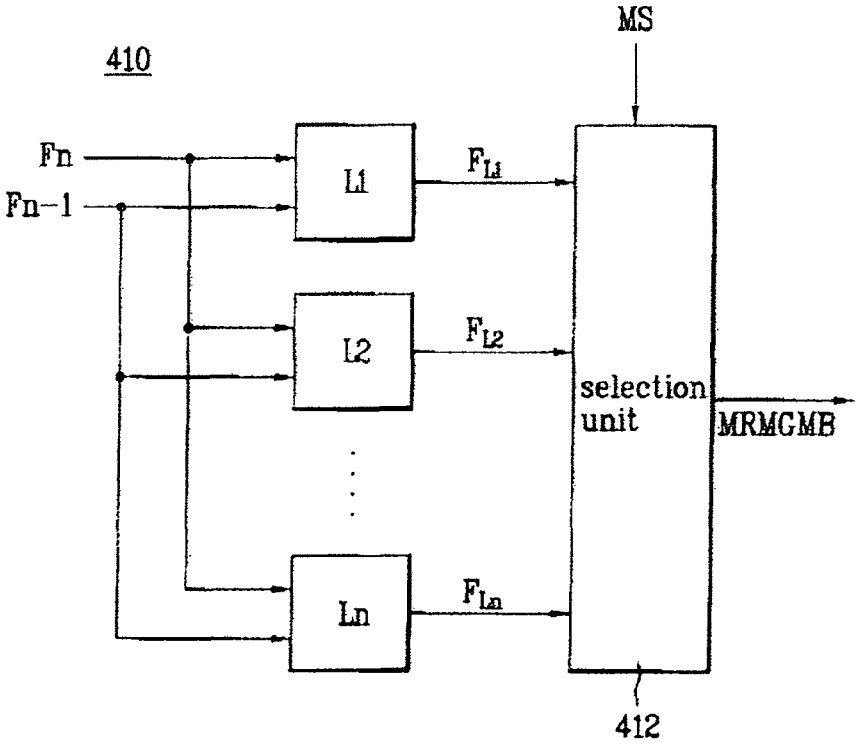
FIG. 7 is a block diagram illustrating an exemplary over-driving data generator of the over-driving apparatus according to the first exemplary embodiment of the present invention.
Figure 8A:
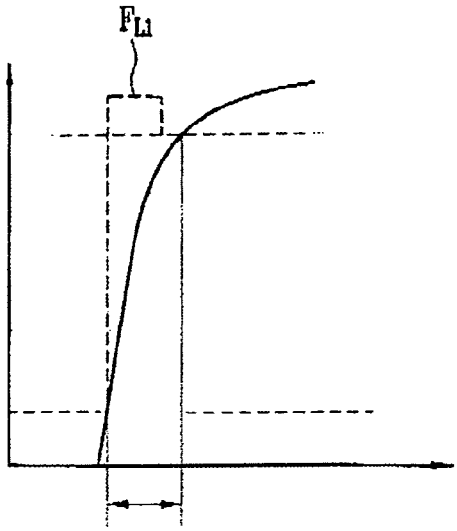
FIGS. 8A to 8D are graphs illustrating a plurality of over-driving data listed in an exemplary look-up table.
Figure 8B:
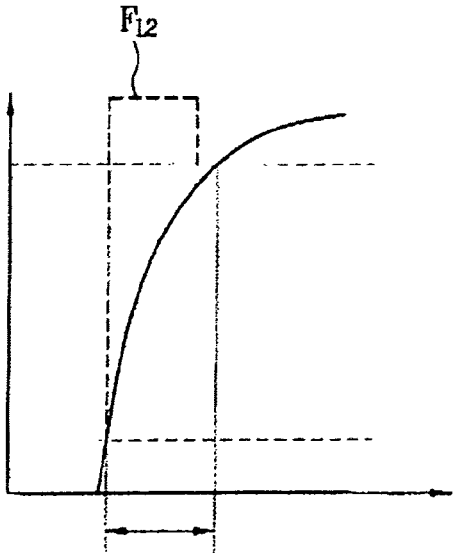
Figure 8C:
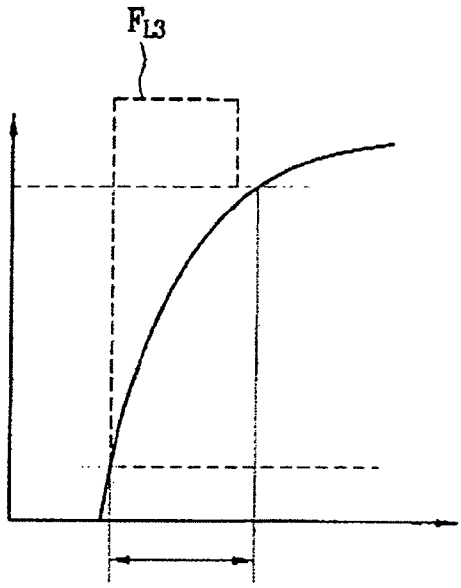
Figure 8D:
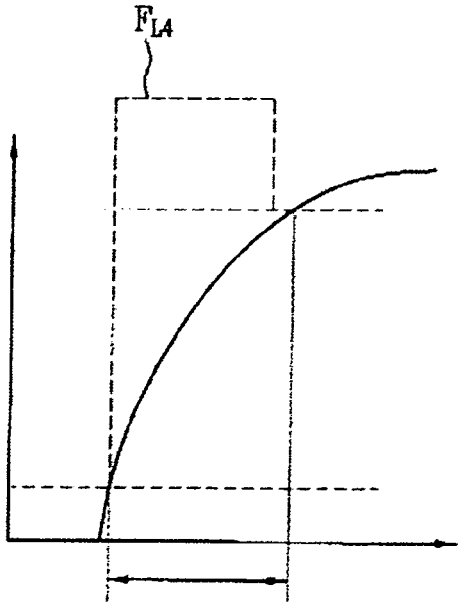

As shown in FIG. 7, the over-driving data generator unit 410 includes first to nth look-up tables L1 to Ln and a selection unit 412. A plurality of sets of the over-driving data are listed in each of the first to nth look-up tables L1 to Ln. As shown in FIG. 8A, the first look-up table L1 generates and lists a first over-driving data FL1 corresponding to a respective two-pixel/frame data. The first look-up table L1 compares the two-pixel/frame over-driving data of the current frame with the two-pixel/frame over-driving data of the previous frame. Accordingly, two-pixel/frame over-driving data obtained from both the current and the previous frames are input in the first look-up table L1 to generate the first over-driving data FL1. Similarly, as shown FIG. 8B, the second look-up table L2 generates and lists a second over-driving data FL2 corresponding to a respective four-pixel/frame data. The second look-up table L2 compares the four-pixel/frame over-driving data of the current frame with the four-pixel/frame over-driving data of the previous frame. Accordingly, four-pixel/frame over-driving data obtained from both the current and the previous frames are input in the second look-up table L2 to generate the second over-driving data FL2. Furthermore, as shown in FIGS. 8C and 8D, the look-up tables L3 and L4 respectively generate and list third over-driving data FL3 corresponding to a respective six-pixel/frame data and fourth over-driving data FL4 corresponding to a respective eight-pixel/frame data in a similar manner as described above. The over-driving data FL1 to FLn are all supplied to the selection unit 412.

As shown in FIG. 7, the selection unit 412 selects the over-driving data MRMGMB among the first to nth over-driving data FL1 to FLn based on the motion size signal Ms detected from the motion detector unit 310. The selected over-driving data MRMGMB is output to the mixing unit 510. The mixing unit 510 mixes the over-driving data MRMGMB and the source data RGB of the current frame Fn and outputs the modulated data R'G'B'. The modulated data R'G'B' prevents the blurring of the moving image on the display screen.

Figure 9:
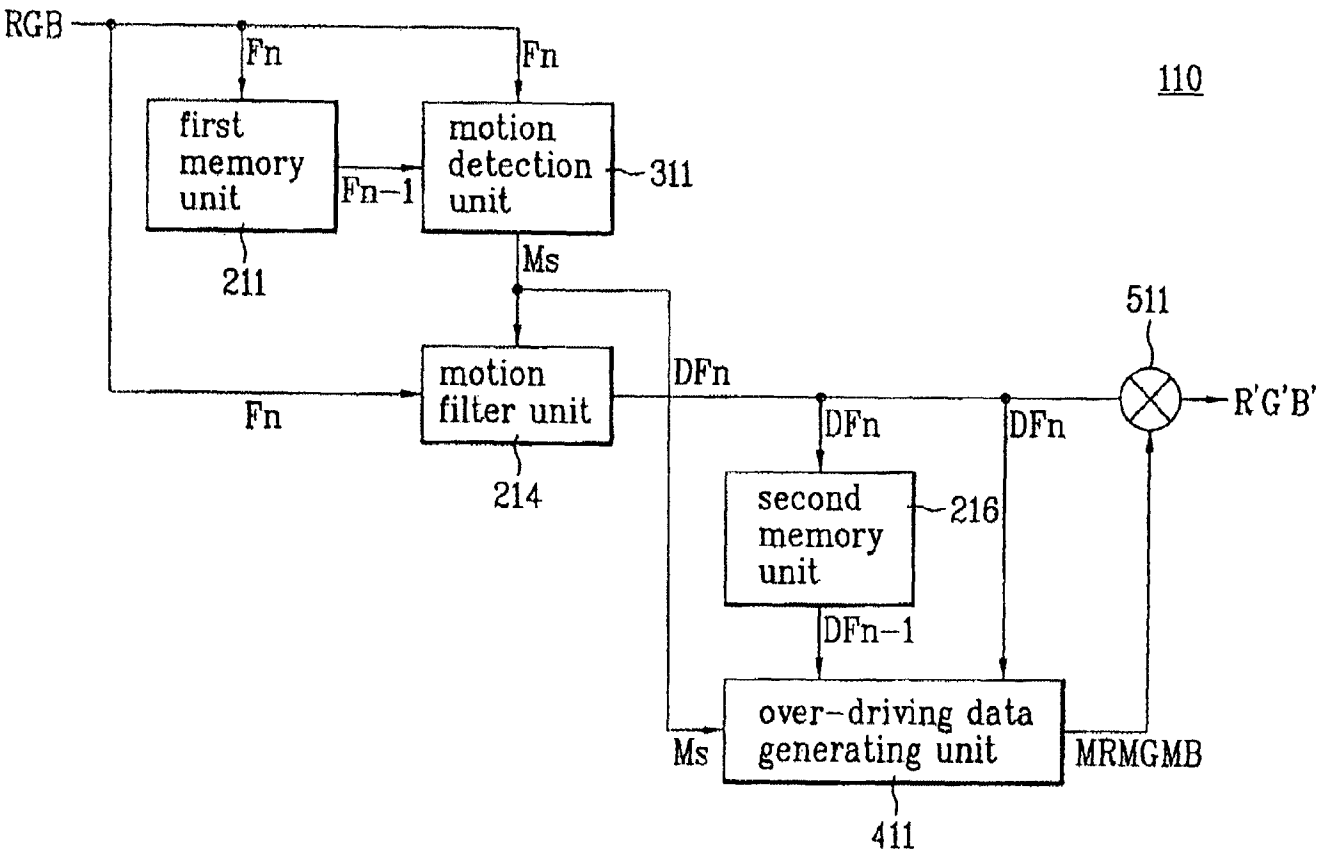
FIG. 9 is a block diagram illustrating an exemplary over-driving apparatus according to a second exemplary embodiment of the present invention.

FIG. 9 is a block diagram illustrating an exemplary over-driving apparatus according to a second exemplary embodiment of the present invention. The exemplary over-driving apparatus according to the second exemplary embodiment includes a structure similar to that of the first exemplary embodiment except that a motion filter unit 214 and multiple memory units 211 and 216 are implemented to generate the modulated data R'G'B'. In detail, the source data RGB of the current frame and the motion size signal Ms are input to the motion filter unit 214. Then, the filtered source data is output to the over-driving data generating unit 411. The motion filter unit 214 is used to generate an undershoot in a boundary of the moving image.

As shown in FIG. 9, the over-driving unit 110 according to the second exemplary embodiment includes a first memory unit 211 to store the source data RGB supplied in a frame unit format, a motion detector unit 311 to detect a motion size signal Ms that corresponds to speed of the moving image, a motion filter unit 214 to filter the source data RGB to generate undershoot in a boundary of the display image based on the motion size signal Ms, a second memory unit 216 to store the filtered data of the current frame DFn supplied in a frame unit format, an over-driving data generator unit 411 unit to generate a plurality of over-driving data using a plurality of look-up tables based on the motion size signal Ms, and a mixing unit 511 to mix the filtered data of the current frame DFn with the over-driving data MRMGMB and output the modulated data R'G'B'.

The first memory unit 211 stores the data RGB of the current frame Fn, and outputs the data of the previous frame Fn-1 to the motion detector unit 311. The motion detector unit 311 detects motion vectors X and Y corresponding to X-axis displacement and Y-axis displacement with respect to with respect to the source data of the previous frame Fn-1 and the source data of the current frame Fn. Then the motion detector unit 311 detects the motion size signal Ms as expressed in the equation 1 and supplies the detected motion size signal Ms to the over-driving data generator unit 411 and the motion filter unit 214.

Figure 10:
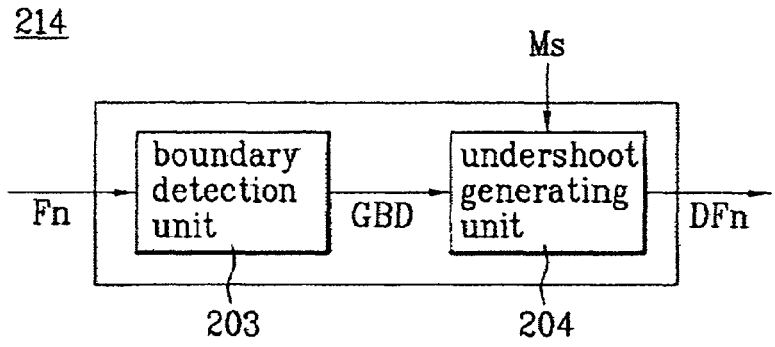
FIG. 10 is a block diagram illustrating an exemplary motion filter of an over-driving data generator according to the second exemplary embodiment of the preset invention.
Figure 12:
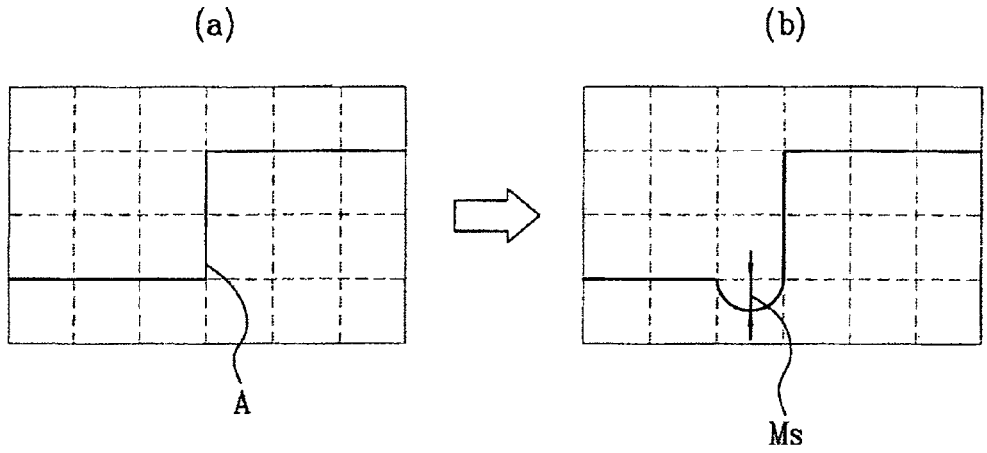
FIGS. 12 and 13 illustrate changes in the boundary waveforms generated by filtering according to the second exemplary embodiment of the present invention.
Figure 13:
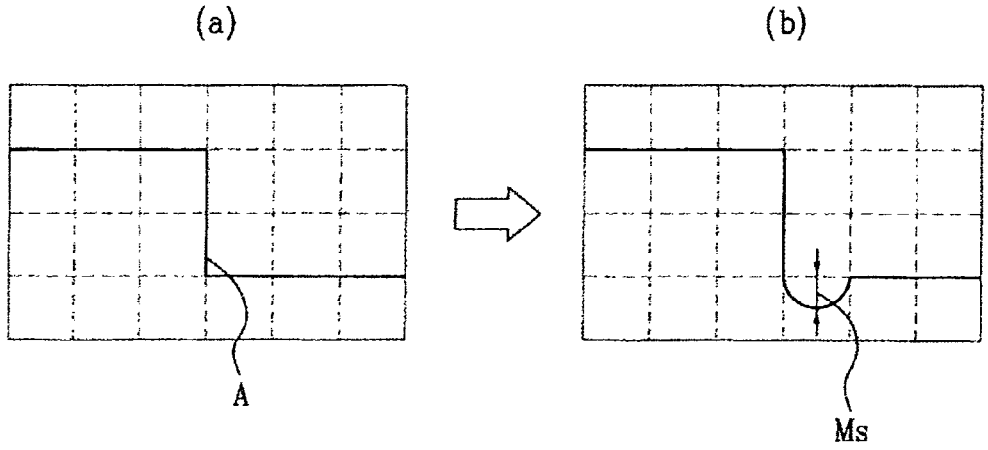

As shown in FIG. 10, the motion filter unit 214 includes a boundary detector unit 203 and an undershoot generator unit 204. The boundary detector unit 203 detects a boundary signal 'GBD' (i.e., "A" of FIGS. 12A and 13A) of the moving image from the data of the current frame, and supplies the detected boundary signal 'GBD' to the undershoot generator unit 204. The undershoot generator unit 204 filters the boundary signal 'GBD' to generate undershoot in the boundary of the display image based on the motion size signal Ms (see FIGS. 12B and 13B). The filtered data of the current frame DFn is supplied to the second memory unit 216. The second memory unit 216 stores the data of the current frame DFn filtered from the motion filter 214.

Figure 11:
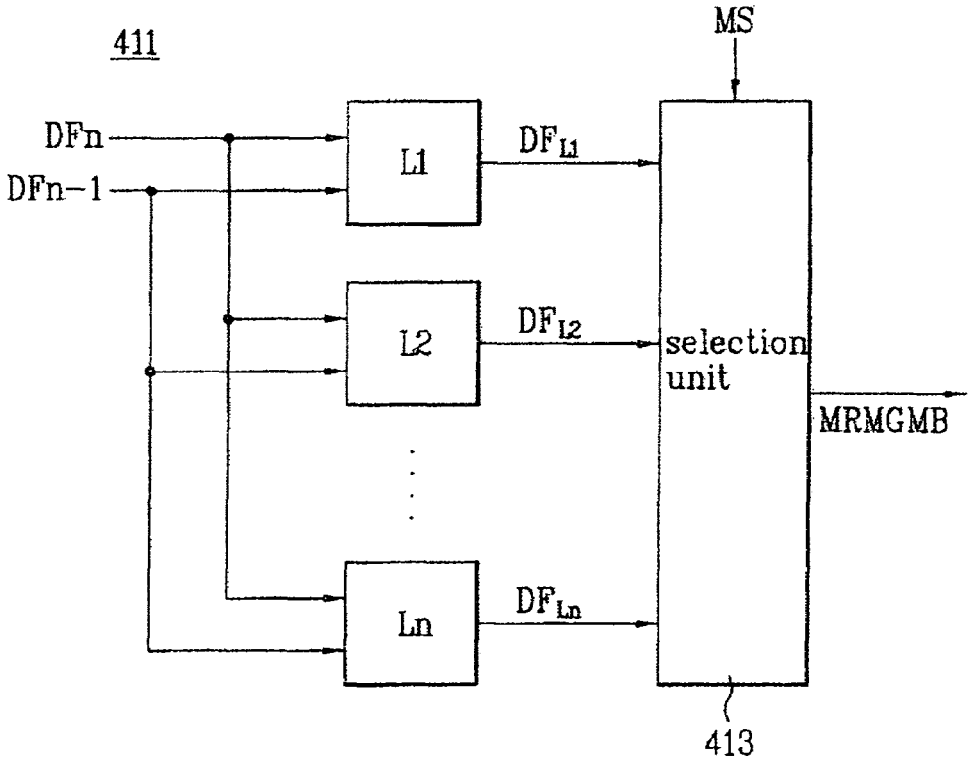
FIG. 11 is a block diagram illustrating an exemplary over-driving data generator of the over-driving apparatus according to the second exemplary embodiment of the present invention.

As shown in FIG. 11 , the over-driving data generator unit 411 includes first to nth look-up tables L1 to Ln and a selection unit 413. As described previously with respect to FIGS. 8A to 8D, each respective look-up table Ln generates and lists a nth over-driving data FLn corresponding to a respective (n×two-pixel)/frame data. The nth look-up table Ln compares the (n×two-pixel)/frame over-driving data of the current frame with the (n×two-pixel)/frame over-driving data of the previous frame. Accordingly, (n×two-pixel)/frame over-driving data obtained from both the current and the previous frames are input in the nth look-up table Ln to generate the first over-driving data FLn.

As shown in FIG. 11, the selection unit 413 selects the over-driving data MRMGMB among the first to nth over-driving data FL1 to FLn based on the motion size signal Ms detected from the motion detector unit 311. The selected over-driving data MRMGMB is output to the mixing unit 511. The mixing unit 511 mixes the over-driving data MRMGMB and the filtered data of the current frame DFn and outputs the modulated data R'G'B'. The modulated data R'G'B' prevents the blurring of the moving image on the display screen.

the exemplary apparatus and method of driving the LCD device according to the second exemplary embodiment of the present invention, the plurality of over-driving data are generated using the plurality of look-up tables. Then the modulated data is selected from the plurality of over-driving data based on the motion size signal, wherein the data of the current and previous frames are filtered to generate undershoot in the boundary of the moving image. In this way, since the modulated data is output in accordance with the motion size signal (i.e., respective motion of the moving image), blurring of the moving image on the display screen can be prevented.

It will be apparent to those skilled in the art that various modifications and variations can be made in the apparatus and method of driving liquid crystal display device of the present invention without departing from the spirit or scope of the invention. Thus, it is intended that the present invention cover the modifications and variations of this invention provided they come within the scope of the appended claims and their equivalents.

What is claimed is:

1. An apparatus for driving an liquid crystal display (LCD) device, comprising:

an image display unit including liquid crystal cells formed in respective regions defined by a plurality of gate lines and a plurality of data lines;

an over-driving apparatus to detect a signal of a moving image based on externally supplied source data and to generate modulated data in accordance with the detected signal, the modulated data changing a response speed of a liquid crystal based on the detected signal;

a gate driver to supply scan signals to the gate lines;

a data driver to convert the modulated data into analog video signals and to supply the analog video signals to the data lines; and a timing controller to align the modulated data and to generate data control signal and gate control signal, the timing controller outputting the aligned data and the data control signal to the data driver and outputting the gate control signal to the gate driver, wherein the over-driving apparatus includes:

a memory to store the source data supplied in a frame unit format, a motion detector to detect a motion size signal that corresponds to a speed of the moving image using the source data of a current frame and the source data of a previous frame stored in the memory, an over-driving data generator to generate a plurality of over-driving data using a plurality of look-up tables and to selectively output a respective one of the plurality of over-driving data in accordance with the motion size signal, the plurality of look-up tables respectively outputting different over-driving data corresponding to motion speed that corresponds to the number of pixels changed per frame of the moving image, and a mixing unit to mix the source data of the current frame with the over-driving data generated by the over-driving data generator and to output the modulated data, wherein the plurality of look-up tables include a first to a fourth look-up tables, wherein two-pixel/frame over-driving data obtained from both the current and the previous frames are input in the first look-up table, wherein the two-pixel/frame over-driving data corresponds to motion speed that corresponds to two pixels changed per frame of the moving image, wherein the first look-up table generates a first over-driving data which corresponds to a motion speed of two-pixels changed pre frame, wherein four-pixel/frame over-driving data obtained from both the current and the previous frames are input in the second look-up table, wherein the four-pixel/frame over-driving data corresponds to motion speed that corresponds to four pixels changed per frame of the moving image, wherein the second look-up table generates a second over-driving data which corresponds to a motion speed of four-pixels changed pre frame, wherein six-pixel/frame over-driving data obtained from both the current and the previous frames are input in the third look-up table, wherein the six-pixel/frame over-driving data corresponds to motion speed that corresponds to six pixels changed per frame of the moving image, wherein the third look-up table generates a third over-driving data which corresponds to a motion speed of six-pixels changed pre frame, wherein eight-pixel/frame over-driving data obtained from both the current and the previous frames are input in the fourth look-up table, wherein the eight-pixel/frame over-driving data corresponds to motion speed that corresponds to eight pixels changed per frame of the moving image, wherein the fourth look-up table generates a fourth over-driving data which corresponds to a motion speed of eight-pixels changed pre frame, wherein the first over-driving data generated by the first look-up table is chosen to be outputted from the over-driving data generator when the detected motion speed is two pixels changed per frame, wherein the second over-driving data generated by the second look-up table is chosen to be outputted from the over-driving data generator when the detected motion speed is four pixels changed per frame, wherein the third over-driving data generated by the third look-up table is chosen to be outputted from the over-driving data generator when the detected motion speed is six pixels changed per frame, and wherein the fourth over-driving data generated by the fourth look-up table is chosen to be outputted from the over-driving data generator when the detected motion speed is eight pixels changed per frame.

2. The apparatus as claimed in claim 1, wherein:

the plurality of look-up tables respectively output different over-driving data by receiving the source data of the current frame and the source data of the previous frame; and the over-driving data generator includes a selector to selectively output a respective one of the over-driving data among the plurality of over-driving data based on the motion size signal.

3. An apparatus for driving an liquid crystal display (LCD) device, comprising:

an image display unit including liquid crystal cells formed in respective regions defined by a plurality of gate lines and a plurality of data lines;

an over-driving apparatus to detect a signal of a moving image based on externally supplied source data and to generate modulated data in accordance with the detected signal, the modulated data changing a response speed of a liquid crystal based on the detected signal;

a gate driver to supply scan signals to the gate lines;

a data driver to convert the modulated data into analog video signals and to supply the analog video signals to the data lines; and a timing controller to align the modulated data and to generate data control signal and gate control signal, the timing controller outputting the aligned data and the data control signal to the data driver and outputting the gate control signal to the gate driver;

a first memory to store the source data supplied in a frame unit format;

a motion detector to detect a motion size signal that corresponds to a speed of the moving image using the source data of the current frame and the source data of the previous frame stored in the first memory;

a motion filter to filter the source data of the current frame based on the motion size signal to generate undershoot in a boundary of the display image;

a second memory to store the filtered source data of the current frame supplied in a frame unit format;

an over-driving data generator to generate a plurality of over-driving data using a plurality of look-up tables and to selectively output a respective one of the plurality of over-driving data based on the motion size signal, the plurality of look-up tables respectively outputting different over-driving data corresponding to motion speed that corresponds to the number of pixels changed per frame of the moving image; and a mixing unit to mix the filtered source data of the current frame with the over-driving data generated by the over-driving data generator and to output modulated data, wherein the plurality of look-up tables include a first to a fourth look-up tables, wherein two-pixel/frame over-driving data obtained from both the current and the previous frames are input in the first look-up table, wherein the two-pixel/frame over-driving data corresponds to motion speed that corresponds to two pixels changed per frame of the moving image, wherein the first look-up table generates a first over-driving data which corresponds to a motion speed of two-pixels changed pre frame, wherein four-pixel/frame over-driving data obtained from both the current and the previous frames are input in the second look-up table, wherein the four-pixel/frame over-driving data corresponds to motion speed that corresponds to four pixels changed per frame of the moving image, wherein the second look-up table generates a second over-driving data which corresponds to a motion speed of four-pixels changed pre frame, wherein six-pixel/frame over-driving data obtained from both the current and the previous frames are input in the third look-up table, wherein the six-pixel/frame over-driving data corresponds to motion speed that corresponds to six pixels changed per frame of the moving image, wherein the third look-up table generates a third over-driving data which corresponds to a motion speed of six-pixels changed pre frame, wherein eight-pixel/frame over-driving data obtained from both the current and the previous frames are input in the fourth look-up table, wherein the eight-pixel/frame over-driving data corresponds to motion speed that corresponds to eight pixels changed per frame of the moving image, wherein the fourth look-up table generates a fourth over-driving data which corresponds to a motion speed of eight-pixels changed pre frame, wherein the first over-driving data generated by the first look-up table is chosen to be outputted from the over-driving data generator when the detected motion speed is two pixels changed per frame, wherein the second over-driving data generated by the second look-up table is chosen to be outputted from the over-driving data generator when the detected motion speed is four pixels changed per frame, wherein the third over-driving data generated by the third look-up table is chosen to be outputted from the over-driving data generator when the detected motion speed is six pixels changed per frame, and wherein the fourth over-driving data generated by the fourth look-up table is chosen to be outputted from the over-driving data generator when the detected motion speed is eight pixels changed per frame.

4. The apparatus as claimed in claim 3, wherein:

the plurality of look-up tables respectively output different over-driving data by receiving the filtered source data of the current frame and the filtered source data of the previous frame; and the over-driving data generator includes a selector to selectively output a respective one of the over-driving data among the plurality of over-driving data based on the motion size signal.

5. The apparatus as claimed in claim 3, wherein the motion filter includes:

a boundary detector to detect a boundary of the moving image from the source data of the current frame and to output a boundary signal; and an undershoot generator to filter the boundary signal to generate undershoot in the boundary of the moving image based on the motion size signal.

6. A method for driving an liquid crystal display (LCD) device having an image display unit to display an image, the method comprising:

detecting a signal of a moving image from externally supplied source data and generating modulated data based on the detected signal, the modulated data changing a response speed of a liquid crystal based on the detected signal;

supplying scan signals to respective gate lines; and converting the modulated data into analog video signals at a time when the conversion is synchronized with the scan signals and supplying the analog video signals to respective data lines, wherein the detecting further includes:

storing the source data supplied in a frame unit format, detecting a motion size signal that corresponds to a speed of the moving image using the source data of a current frame and the source data of a previous frame, generating a plurality of over-driving data using a plurality of look-up tables and selectively outputting a respective one of the plurality of over-driving data in accordance with the motion size signal, the plurality of look-up tables respectively outputting different over-driving data corresponding to motion speed that corresponds to the number of pixels changed per frame of the moving image, and outputting the modulated data by mixing the source data of the current frame with the selected over-driving data, wherein the plurality of look-up tables include a first to a fourth look-up tables, wherein two-pixel/frame over-driving data obtained from both the current and the previous frames are input in the first look-up table, wherein the two-pixel/frame over-driving data corresponds to motion speed that corresponds to two pixels changed per frame of the moving image, wherein the first look-up table generates a first over-driving data which corresponds to a motion speed of two-pixels changed pre frame, wherein four-pixel/frame over-driving data obtained from both the current and the previous frames are input in the second look-up table, wherein the four-pixel/frame over-driving data corresponds to motion speed that corresponds to four pixels changed per frame of the moving image, wherein the second look-up table generates a second over-driving data which corresponds to a motion speed of four-pixels changed pre frame, wherein six-pixel/frame over-driving data obtained from both the current and the previous frames are input in the third look-up table, wherein the six-pixel/frame over-driving data corresponds to motion speed that corresponds to six pixels changed per frame of the moving image, wherein the third look-up table generates a third over-driving data which corresponds to a motion speed of six-pixels changed pre frame, wherein eight-pixel/frame over-driving data obtained from both the current and the previous frames are input in the fourth look-up table, wherein the eight-pixel/frame over-driving data corresponds to motion speed that corresponds to eight pixels changed per frame of the moving image, wherein the fourth look-up table generates a fourth over-driving data which corresponds to a motion speed of eight-pixels changed pre frame, wherein the first over-driving data generated by the first look-up table is chosen to be outputted from the over-driving data generator when the detected motion speed is two pixels changed per frame, wherein the second over-driving data generated by the second look-up table is chosen to be outputted from the over-driving data generator when the detected motion speed is four pixels changed per frame, wherein the third over-driving data generated by the third look-up table is chosen to be outputted from the over-driving data generator when the detected motion speed is six pixels changed per frame, and wherein the fourth over-driving data generated by the fourth look-up table is chosen to be outputted from the over-driving data generator when the detected motion speed is eight pixels changed per frame.

7. The method as claimed in claim 6, wherein the generating the plurality of over-driving data further includes:

respectively outputting different over-driving data by receiving the source data of the current frame and the source data of the previous frame; and selectively outputting a respective one of the over-driving data among the plurality of over-driving data based on the motion size signal.

8. A method for driving an liquid crystal display (LCD) device having an image display unit to display an image, the method comprising:

detecting a signal of a moving image from externally supplied source data and generating modulated data based on the detected signal, the modulated data changing a response speed of a liquid crystal based on the detected signal;

supplying scan signals to respective gate lines;

converting the modulated data into analog video signals at a time when the conversion is synchronized with the scan signals, and supplying the analog video signals to respective data lines, wherein two-pixel/frame over-driving data, obtained from both the current and the previous frames, are input in the first look-up table, wherein the two-pixel/frame over-driving data corresponds to motion speed that corresponds to two pixels changed per frame of the moving image, wherein the first look-up table generates a first over-driving data which corresponds to a motion speed of two-pixels changed pre frame;

wherein four-pixel/frame over-driving data obtained from both the current and the previous frames are input in the second look-up table, wherein the four-pixel/frame over-driving data corresponds to motion speed that corresponds to four pixels changed per frame of the moving image, wherein the second look-up table generates a second over-driving data which corresponds to a motion speed of four-pixels changed pre frame, wherein six-pixel/frame over-driving data obtained from both the current and the previous frames are input in the third look-up table, wherein the six-pixel/frame over-driving data corresponds to motion speed that corresponds to six pixels changed per frame of the moving image, wherein the third look-up table generates a third over-driving data which corresponds to a motion speed of six-pixels changed pre frame, wherein eight-pixel/frame over-driving data obtained from both the current and the previous frames are input in the fourth look-up table, wherein the eight-pixel/frame over-driving data corresponds to motion speed that corresponds to eight pixels changed per frame of the moving image, wherein the fourth look-up table generates a fourth over-driving data which corresponds to a motion speed of eight-pixels changed pre frame;

wherein the first over-driving data generated by the first look-up table is chosen to be outputted from the over-driving data generator when the detected motion speed is two pixels changed per frame, wherein the second over-driving data generated by the second look-up table is chosen to be outputted from the over-driving data generator when the detected motion speed is four pixels changed per frame, wherein the third over-driving data generated by the third look-up table is chosen to be outputted from the over-driving data generator when the detected motion speed is six pixels changed per frame, and wherein the fourth over-driving data generated by the fourth look-up table is chosen to be outputted from the over-driving data generator when the detected motion speed is eight pixels changed per frame.

9. The method as claimed in claim 8, wherein the generating the plurality of over-driving data includes:

respectively outputting different over-driving data by receiving the filtered source data of the current frame and the filtered source data of the previous frame; and selectively outputting a respective one of the over-driving data among the plurality of over-driving data based on the motion size signal.

10. The method as claimed in claim 8, wherein the filtering further includes:

detecting a boundary of the moving image from the source data of the current frame and outputting a boundary signal; and filtering the boundary signal to generate undershoot in the boundary of the moving image based on the motion size signal.

* * * * *